US005270355A

United States Patent [19]

Kawano et al.

[11] Patent Number: 5,270,355

[45] Date of Patent: Dec. 14, 1993

[54] PAPER COATING RESIN AND PAPER COATING COMPOSITION

[75] Inventors: Hiroharu Kawano; Satoshi Takizawa; Hiroki Owaki; Haruka Hirayama, all of Ichihara, Japan

[73] Assignee: DIC-Hercules Chemicals, Inc., Tokyo, Japan

[21] Appl. No.: 819,859

[22] Filed: Jan. 13, 1992

[30] Foreign Application Priority Data

Jan. 14, 1991 [JP] Japan ..... 3-016024
Feb. 14, 1991 [JP] Japan ..... 3-040801

[51] Int. Cl.[5] ..... C08K 3/20

[52] U.S. Cl. ..... 523/404; 528/230; 528/245; 528/250

[58] Field of Search ..... 523/404; 528/230, 245, 528/250

[56] References Cited

U.S. PATENT DOCUMENTS 3,129,133 4/1964 Doyle ..... 523/404

FOREIGN PATENT DOCUMENTS 0220960 5/1987 European Pat. Off. .
44-11667 5/1969 Japan .
51-121041 10/1976 Japan .
52-137015 11/1977 Japan .
56-37397 4/1981 Japan .
61-215794 9/1986 Japan .

*Primary Examiner*—Melvyn I. Marquis
*Assistant Examiner*—D. Aylward
*Attorney, Agent, or Firm*—Stevens, Davis, Miller & Mosher

[57] ABSTRACT

A paper coated resin has been provided which simultaneously provides coated papers with improved ink receptivity, water resistance and blister resistance in a good balance. The resin is obtainable by introducing alicyclic amino and/or alicyclic epoxy compounds into a polyalkylenepolyamine-urea-aldehyde(epihalohydrin) resin or by introducing alicyclic amino and/or alicyclic epoxy compounds into a polyalkylenepolyamine-urea-aldehyde(epihalohydrin) resin and/or an amine-epihalohydrin resin and reacting or mixing these resins.

2 Claims, No Drawings

PAPER COATING RESIN AND PAPER COATING COMPOSITION

FIELD OF THE INVENTION

This invention relates to paper coating resins and paper coating compositions comprising the same which provide coated papers with improved ink receptivity, water resistance and blister resistance in a good balance.

BACKGROUND OF THE INVENTION

Coated papers which are widely used as printing papers have been conventionally manufactured by coating base papers with a composition mainly consisting of a pigment such as clay and calcium carbonate and binders such as latex and starch. With remarkable development in the printing technology of recent years exemplified by printing at a higher speed, with higher resolution and/or in more colors, higher level printability has come to be required for coated papers. In particular, the following three properties are strongly required: (i) ink receptivity which means how well ink takes on the paper when the printing is carried out; (ii) resistance to the damping water which is applied on the paper in the offset printing; and (iii) resistance to blister which may occur as the ink dries in the webb offset printing.

Various types of resins have been developed so as to provide coated papers with the above-mentioned properties necessary for good printing. A polyalkylenepolyamine-urea-formaldehyde resin is one of such resins and combinationed use of a polyalkylenepolyamine-urea-formaldehyde resin and a dialdehyde is suggested for this purpose (see Japanese Laid-open publication No. 51-121041, for example). We have also tried combinationed use of a polyalkylenepolyamine-urea-aldehyde resin and an amine-epihalohydrin resin by mixing and/or reacting these resins.

These efforts are, however, not successful in achieving a well-balanced improvement in the above-mentioned three properties (ink receptivity, water resistance and blister resistance) and, therefore, such an improved resin as satisfies the requirements is desired. Especially it is very difficult to improve both the ink receptivity and the water resistance in a good balance. For example, when the ink receptivity is tried to be enhanced by making the coating layer more permeable to the damping water, the water resistance thereof is impaired and the phenomenon that the surface of the coating layer is partially taken off by the inking roller (so-called "wet pick") is more liable to occur.

DISCLOSURE OF THE INVENTION

We have conducted an intensive study for solving the above-described problems and found that this object can be achieved by introducing an alicyclic amino compound and/or an alicyclic epoxy compound into a polyalkylenepolyamine-urea-aldehyde(epihalohydrin) resin or by introducing these alicyclic compounds into a polyalkylenepolyamine-urea-aldehyde(epihalohydrin) resin and/or an amine-epihalohydrin resin and reacting or mixing these resins and thus completed the present invention.

Accordingly, the present invention provides paper coating resins comprising a reaction product of a polyalkylenepolyamine, an alicyclic amino compound and/or an alicyclic epoxy compound, a urea and one or two or more compounds selected from formaldehyde, epihalohydrins and dialdehydes and paper coating compositions comprising the same.

Furthermore, the present invention provides paper coating resins comprising a reaction product or a mixture of (a) a polyalkylenepolyamine-ureaaldehyde(epihalohydrin) resin which is either (I) a water soluble resin comprising the reaction product of a polyalkylenepolyamine, an alicyclic amino compound and/or an alicyclic epoxy compound, a urea and one or two or more compounds of formaldehyde, epihalohydrins and dialdehydes or (II) a water soluble resin comprising the reaction product of a polyalkylenepolyamine, a urea and one or two or more compounds of formaldehyde, epihalohydrins and dialdehydes; and (b) an amine-epihalohydrin resin selected from (III) a water soluble resin comprising the reaction product of an epihalohydrin, an aliphatic amino compound and an alicyclic amino compound and/or an alicyclic epoxy compound; (IV) a water soluble resin comprising the reaction product of an epihalohydrin and an aliphatic amino compound; (V) a water soluble resin comprising the reaction product of an epihalohydrin, an aliphatic amino compound and an alicyclic amino compound and/or an alicyclic epoxy compound, and a sulfite and/or an acid; and (VI) a water soluble resin comprising the reaction product of an epihalohydrin, an aliphatic amino compound and a sulfite and/or an acid (wherein the reaction product or mixture of the above (II) and (IV), and (II) and (IV) are excluded) as well as paper coating compositions comprising the same.

The features of the present invention will be made clear from the following description.

Preferred polyalkylenepolyamines for use in the present invention are the compounds having at least two primary amino groups and at least one secondary amino group per molecule. Typical examples of such compounds include polyethylenepolyamine, polypropylenepolyamine and polybutylenepolyamine. Among these compounds, polyethylenepolyamine is preferred. Examples of the polyehylenepolyamine include diethylenetriamine, triethylenetetramine and tetraethylenepentamine.

These polyalkylenepolyamines can be used singly or combination of two or more thereof. Diamines such as ethylenediamine, propylenediamine and hexamethylenediamine and monoamines such as dimethylamine, monoethanolamine and benzylamine can also be used along with polyalkylenepolyamines in a ratio of not more than 60 mol to 100 mol of polyalkylenepolyamines.

Examples of ureas useful in the present invention include urea, thiourea, guanylurea, methylurea, dimethylurea and the like, urea being preferred.

Alicyclic amino compounds useful in the present invention are the compounds having at least one active hydrogen group per molecule. Typical examples of such compounds include cyclohexylamine, dicyclohexylamine, 1,3-diaminocyclohexane, 1.4-diaminocyclohexane, 4.4'-diamino-3,3'-dimethyl-dicyclohexylmethane, 4.4'-diamino-3,3'-di-methyldicyclohexane, 4,4'-bis(paraaminocyclohexyl)methane, isophoronediamine, 1,3(or 2,4)-bis-(aminomethyl)cyclohexane, N-aminopropylcyclohexylamine, octahydro-4,7-metanoidene-1(2), 5(6)-dimethaneamine, 2,2'-bis-(4-amino-cyclohexyl)propane, bis-(4-aminocyclohexyl)methane, 4,4'-oxybis(cyclohexylamine), 4,4'-sulfonbis(cyclohexylamine), 1,3,5-triaminocyclohexane, 2,4'- or 4,4'- diamino-3,3'-5,5'-tetraalkyldicyclohexylalkane and the like.

Alicyclic epoxy compounds useful in the present invention are the compounds having an epoxy group directly or indirectly attached to, for instance, a cyclohexane ring. Examples of the compounds having directly attached epoxy groups include cyclohexeneoxide, vinylcyclohexene-dioxide, bis(3,4-epoxycyclohexyl)adipate, 3,4-epoxycyclo-hexylmethyl-3,4-epoxycyclohexane-carboxylate, 2-(3,4-epoxycyclohexyl-5,5-spiro-3,4-epoxy)cyclohexane-meta-dioxane. Here the term "having indirectly attached an epoxy group" means that the compound contains an epoxy group such as glycidyl group along with a cyclohexane ring. Examples thereof include bis-glycidyl-hexahydro-phthalate, 2,2-bis(4'-glycidyloxy-cyclohexyl)propane and the like.

Epihalohydrins useful in the present invention include epichlorohydrin, epibromohydrin and the like, which can be used singly or in combination. Dialdehydes useful in the present invention include glyoxal, glutaraldehyde and the like.

Aliphatic amino compounds useful in the present invention are ammonia and compounds containing one or more primary, secondary or tertiary amino groups, which include monoamines such as methylamine, dimethylamine, trimethylamine, ethylamine, diethylamine, triethylamine, propylamine, butylamine, ethanolamine, 3-ethoxypropylamine and the like, diamines such as ethylenediamine, hexamethylenediamine and the like, and polyamines such as diethylenetriamine, triethylenetetramine, tetraethylenepentamine and the like.

Sulfites usable in the present invention include sulfites ($M^1{}_2SO_3$, wherein $M^1$ represents a monovalent metal), hydrogensulfites ($M^1HSO_3$), pyrosulfites ($M^1{}_2S_2O_5$), etc. Typical examples of $M^1$ are alkali metals. These are used singly or in combination and the sulfite ions resulting therefrom include metal sulfite ions $M^1SO_3^-$, hydrogen-sulfite ion $HSO_3^-$, pyrosulfite ion $S_2O_5^{2-}$, sulfite ion $SO_3^{2-}$, metal pyrosulfite ions $M^1S_2O_5^-$, hydrogen pyrosulfite ion $HS_2O_5^-$, etc. These are exemplified by sodium sulfite $Na_2SO_3$, sodium hydrogensulfite $NaHSO_3$, anhydrous sodium bisulfite $Na_2S_2O_5$, etc.

Acids usable in the present invention include inorganic acids such as sulfuric acid, hydrochloric acid, phosphoric acid, etc. and organic acids such as formic acid, acetic acid, etc.

Use of a sulfite decreases the cationicity of the paper coating resin and prevents increase in viscosity of the paper coating composition.

When an acid is used, amino groups are partly or completely converted to amine salts and the reaction with epihalohydrin then gives amine-epihalohydrin resins having a lower molecular weight, which also prevents the viscosity increase of the paper coating composition.

The ratio of the reactants, i.e. a polyalkylenepolyamine, a urea, an alicyclic amino compound and an alicyclic epoxy compound to form a polyalkylenepolyamine-urea-alicyclic amino compound and/or an alicyclic epoxy compounds-aldehyde(epihalohydrin) resin of the present invention is preferably in the range of 0.5–10 mol of a urea and 0.02–5 mol of an alicyclic amino compound and/or an alicyclic epoxy compound (total amount when used in combination) to 1 mol of a polyalkylenepolyamine.

The preferred amount of formaldehyde, an epihalohydrin or a dialdehyde is 0.1–3 mol in the case of single use and 0.1–4 mol in the case of combinationed use, respectively to 1 mol of a polyalkylenepolylamine.

With regard to the reaction among a polyalkylenepolyamine, a urea, an alicyclic amino compound and an alicyclic epoxy compound, they can be reacted in any order.

The reaction product (I) can be obtained., for example, in accordance with any of the following processes (I)-1 to (I)-5.

Process (I)-1: A polyalkylenepolyamine, an alicyclic amino compound and/or an alicyclic epoxy compound and a urea are subjected to deammoniation reaction at 80°–200° C. for 0.5–10 hours, diluted with water and further reacted with one or two or more of formaldehyde, epihalohydrins and dialdehydes in any order in accordance with a conventional process to introduce reactive groups.

Process (I)-2: A polyalkylenepolyamine, a urea, an alicyclic amino compound and an alicyclic epoxy compound may be reacted in twice. For example, a polyalkylenepolyamine, an alicyclic amino compound and/or an alicyclic epoxy compound and a urea are subjected to deammoniation reaction at 80°–200° C. for 0.5–10 hours, the polyalkylenepolyamine and/or the alicyclic amino compound and/or the alicyclic epoxy compound and/or the urea are added to the resulting reaction mixture and the mixture was allowed to react at 80°–200° C. for 0.5–10 hours. Then the reaction mixture is diluted with water and subsequently reacted with one or two or more of formaldehyde, epihalohydrins and dialdehydes in any order in accordance with a conventional process to introduce reactive groups.

Process (I)-3: The reaction may be carried out first between a polyalkylenepolyamine and an alicyclic epoxy compound and then with a urea. For example, a polyalkylenepolyamine and an alicyclic epoxy compound are reacted at 60°–200° C. for 0.5–5 hours, a urea is added to the reaction mixture and deammoniation reaction is carried out at 80°–200° C. for 0.5–10 hours. Then the reaction mixture is diluted with water and subsequently reacted with one or two or more of formaldehyde, epihalohydrins and dialdehydes in any order in accordance with a conventional process to introduce reactive groups.

Process (I)-4: The reaction among a polyalkylenepolyamine, a urea, an alicyclic amino compound and/or an alicyclic epoxy compound may be carried out first, followed by the reaction with the alicyclic amino compound and/or the alicyclic epoxy compound and then with the urea. For example, a polyalkylenepolyamine, an alicyclic amino compound and/or an alicyclic epoxy compound and a urea are subjected to deammoniation reaction at 80°–200° C. for 0.5–10 hours, the alicyclic amino compound and/or the alicyclic epoxy compound and a urea are added thereto and reacted at 80°–200C. for 0.5–5 hours. Then the reaction mixture is diluted with water and subsequently reacted with one or two or more of formaldehyde, epihalohydrins and dialdehydes in any order in accordance with a conventional process to introduce reactive groups.

Process (I)-5: The reaction between a polyalkylenepolyamine and a urea may be carried out first and then the reaction with an alicyclic amino compound and/or an alicyclic epoxy compound and with the urea may be simultaneously carried out. For example, a polyalkylenepolyamine and a urea are reacted at 80°–200° C. for 0.5–10 hours, an alicyclic amino compound and/or an alicyclic epoxy compound and a urea are added thereto and reacted at 80°-200C. for 0.5-5 hours. The alicyclic amino compound and/or the alicyclic epoxy compound and the urea are added thereto and deammoniation reaction is carried out at 80°-200° C. for 0.5-10 hours. Then the reaction mixture is diluted with water and subsequently reacted with one or two or more of formaldehyde, epihalohydrins and dialdehydes in any order in accordance with a conventional process to introduce reactive groups.

The reaction product (II) can be obtained, for example, in the same manner as described in the above (I)-1 and (I)-2 except that no alicyclic compounds are used.

The ratio of the reactants for the amine-epihalohydrin resins of the present invention, i.e. aliphatic amino compounds, alicyclic epoxy compounds, alicyclic amino compounds, epihalohydrins, sulfites and acids are preferably in the range of 0.01-0.5 mol of alicyclic amino compounds and/or alicyclic epoxy compounds (only usable in (III) and (V); total amount when used in combination), 0.05-3 mol of epihalohydrins, 0.03-1.5 mol of sulfites (only usable in (V) and (VI)) and 0.1-0.5 of acids (only usable in (V) and (VI)) respectively to 1 mol of the amino group of the aliphatic amino compounds.

With regard to the reaction among an alicyclic epoxy compound, an alicyclic amino compound, an aliphatic amino compound, an epihalohydrin, a sulfite and an acid, they can be reacted in any order.

The reaction product (III) can be obtained, for example, in accordance with the following processes (III)-1 or (III)-2.

Process (III)-1: An epihalohydrin is added dropwise to an aliphatic amino compound containing an alicyclic epoxy compound and/or an alicyclic amino compound at a temperature of not higher than 40° C. for 0.5-3 hours and the reaction mixture is kept at a temperature of 40°-80° C. for 0-4 hours.

Process (III)-2: The reaction among an aliphatic amino compound and an alicyclic epoxy compound and/or an alicyclic amino compound can be carried out stepwise. For example, an epihalohydrin is added dropwise to an aliphatic amino compound at a temperature not higher than 40° C. for 0.5-3 hours and then an alicyclic epoxy compound and/or an alicyclic amino compound are added thererto and the reaction mixture is kept at a temperature of 40°-80° C. for 0.5-4 hours.

The reaction product (IV) can be obtained, for example, by dropping an epihalohydrin into an aliphatic amino compound at a temperature of not higher than 40° C. for 0.5-3 hours and keeping the reaction mixture at a temperature of 40°-80° C. for 0-4 hours after the addition is completed.

The reaction product (V) can be obtained, for example, in accordance with any of the following processes (V)-1 to (V)-4.

Process (V)-1: An epihalohydrin is added dropwise to an aliphatic amino compound containing an alicyclic epoxy compound and/or an alicyclic amino compound at a temperature not higher than 40° C. for 0.5-3 hours, the reaction mixture is kept at a temperature of 40°-80° C. for 0-4 hours and after a sulfite is added thereto it is kept at a temperature of 40°-80° C. for 0.5-4 hours.

Process (V)-2: An epihalohydrin is added dropwise to a mixture of an aliphatic amino compound containing an alicyclic epoxy compound and/or an alicyclic amino compound and a sulfite at a temperature of not higher than 40° C. for 0 5-3 hours and the reaction mixture is kept at a temperature of 40°-80° C. for 0-4 hours.

Process (V)-3: An aliphatic amino compound containing an alicyclic epoxy compound and/or an alicyclic amino compound are added to a product of an epihalohydrin and a sulfite which have been reacted at a temperature 40°-80° C. for 0.5-4 hours or a mixture thereof Then the mixture is allowed to react at a temperature 40°-80° C. for 0.5-4 hours.

Process (V)-4: The reaction can be effected after the activity of the amino groups has been reduced by adding an acid to an aliphatic amino compound containing an alicyclic epoxy compound and/or an alicyclic amino compound. For example, after an acid is added to an aliphatic amino compound containing an alicyclic epoxy compound and/or an alicyclic amino compound, an epihalohydrin is added dropwise thereto at a temperature of not higher than 50° C. for 0 5-2 hours and the reaction mixture is kept at a temperature of 50°-80° C. for 0.5-4 hours.

The reaction product (VI) can be obtained, for example, in accordance with any of the following processes (VI)-1 to (VI)-4.

Process (VI)-1: An epihalohydrin is added dropwise to an aliphatic amino compound at a temperature not higher than 40° C. for 0.5-3 hours. After the addition is completed, the reaction mixture is kept at a temperature of 40°-80° C. for 0-4 hours. A sulfite is added thereto and the mixture is kept at a temperature of 40°-80° C. for 0.5-4 hours.

Process (VI)-2: An epihalohydrin is added dropwise to a mixture of an aliphatic amino compound and a sulfite at a temperature of not higher than 40° C. for 0.5-3 hours. After the addition is completed, the reaction mixture is kept at a temperature of 40°-80° C. for 0-4 hours.

Process (VI)-3: An aliphatic amino compound is added to a product of an epihalohydrin and a sulfite which have been reacted at a temperature of 40°-80° C. for 0.5-4 hours or a mixture thereof. Then the mixture is allowed to react at a temperature of 40°-80° C. for 0.5-4 hours.

Process (VI)-4: The reaction can be effected after the activity of the amino groups has been reduced by adding an acid to an aliphatic amino compound. For example, after an acid is added to an aliphatic amino compound, an epihalohydrin is added dropwise thereto at a temperature of not higher than 50° C. for 0.5-2 hours and the reaction mixture is kept at a temperature of 50°-80° C. for 0.5-4 hours.

According to the present invention, the above-described Resin (I) can be used solely. But it is also used in combination with a resin selected from the resin group (b). That is, a polyalkylenepolyamine-urea-aldehyde(epihalohydrin) resin of group (a) is reacted or mixed with an amine-epihalohydrin resin of group (b). They can be added separately to the paper coating composition as well.

The two types of resins can be reacted at a temperature of 30°-90° C. for 20min to 10 hours. The content ratio or the mixing ratio is not limited. The higher the content ratio of the resin (a) is, the more excellent the ink receptivity and the blister resistance but in some combinations of the resins the higher content ratio of the resin (b) causes viscosity increase containing the same. Preferred content ratio is determined for each combination of the resins in consideration of the use thereof.

The resins of the present invention are useful especially for coating of paper but can be also used in applications other than paper-making.

The resin of the present invention can be used solely but preferably it is used in the form of a paper coating composition with pigments, binders and the other additives.

Pigments usable for this purpose include inorganic pigments such as clay, talc, ground calcium carbonate, precipitated calcium carbonate, satin white, titanium dioxide, aluminum hydroxide, barium sulfate, calcium sulfite, synthesized silica, zinc oxide and the like and organic pigments such as styrene polymer, urea polymer and the like. One of them can be used singly or in combination of two or more thereof.

Examples of the binders include natural polymers and derivatives thereof such as starch, modified starch (oxidized starch, esterified starch, etherified starch, enzymatically modified starch, alpha starch, cationized starch, etc. ), casein, gelatin, soybean protein, yeast protein, cellulose derivatives (carboxymethylcellulose, hydroxyethylcellulose, etc.), synthesized polymers such as styrene-butadiene resin, (meta)acrylate-butadiene resin, (meta)acrylate resin, polyvinyl alcohol, vinyl acetate resin, acrylamide resin, styrene-(meta)acrylate resin, styrene-maleic acid resin, ethylene-vinyl acetate resin and the like.

Optionally, additives other than the above-mentioned pigments and binders may be added to the paper coating composition of the present invention. Examples of such additives include dispersant, lubricant, thickener, viscosity decreasing agent, defoaming agent, anti-foaming agent, antiseptic agent, fungicide, water retentioner, fluorescent whitening agent, dye, conductivity providing agent and the like. Preferred range of the content ratio is 0.05–5 weight parts of the paper coating resin and 5–50 weight parts of binders (as solids content) to 100 weight parts of pigments.

Preparation of the paper coating composition can be carried out, for example, by dispersing pigments along with dispersant in the water, adding binders thereto together with a viscosity controlling agent if necessary, adding the printability aid of the present invention thereto, agitating the mixture and, if necessary, adjusting the pH thereof with caustic soda, ammonia or the like.

The paper coating composition of the present invention is applied to the base paper in accordance with a conventional method. That is any method using blade coater, air knife coater, bar coater, roll coater, size press coater, doctor coater, brush coater, curtain coater, gravure coater, cast coater, champrex coater or any other conventional method is applicable and either of on-machine coating and off-machine coating is possible. The composition can be used in single layer coating as well as in multi-layer coating and is useful in one-side coating as well as both-side coating.

The coating step will be followed by a drying step using gas heater, electric heater, steam-heat heater, thermal ray heater, hot air heater or the like. Any other conventional drying method normally used may be applicable. Optionally, a finishing treatment to provide paper with gloss may be effected using super calender, water calender, gloss calender or the like. Any other treatment normally employed is also applicable.

EMBODIMENT OF THE INVENTION

The present invention will be illustrated more clearly by way of the following working and comparative examples.

EXAMPLE 1

292 g of triethylenetetramine, 98 g of cyclohexeneoxide and 300 g of urea were put in a four-necked flask equipped with a thermometer, a condenser and an agitator, subjected to deammoniation reaction at 120° C. for 3 hours and diluted with water into a 60% aqueous solution. 81 g of a 37% formalin aqueous solution was added thereto and the pH thereof was adjusted to 5 with a 50% sulfuric acid aqueous solution and the reaction solution was kept at 80° C. under agitation for 3 hours. After the reaction was concluded, the pH of the solution was adjusted to 7 with a 28% aqueous ammonia solution and diluted with water to form a water-soluble resin solution containing 50% solids. It is designated Resin Solution (a-1).

EXAMPLE 2

206 g of diethylenetriamine, 59 g of octahydro-4,7-metanoindene-1(2), 5(6)-dimethaneamine and 90 g of urea were put in the same reaction container as used in Example 1, subjected to deammoniation reaction at 160° C. for 2 hours. After addition of 120 g of urea, the deammoinia reaction was carried out again at 120° C. for 2.5 hours. The reaction solution was diluted with water into a 60% aqueous solution. 122 g of a 37% formalin aqueous solution was added thereto and the pH thereof was adjusted to 6 with a 98% sulfuric acid aqueous solution and the reaction solution was kept at 80° C. under agitation for 5 hours. After the reaction was concluded, the pH of the solution was adjusted to 8 with a 30% sodium hydroxide aqueous solution and diluted with water to form a water-soluble resin solution containing 50% solids. It is designated Resin Solution (a-2).

EXAMPLE 3

206 g of diethylenetriamine, 76 g of 3,4-epoxycyclohexylmetyl-3,4-epoxycyclohexane-carboxylate were put in the same reaction container as used in Example 1, reacted at 120° C. for one hour under a careful temperature control. Then 180 g of urea was added to the solution and it was subjected to deammoniation reaction at 160° C. for 3 hours. The solution was diluted with water into a 60% aqueous solution. 81 g of a 37% formalin aqueous solution was added thereto and the pH thereof was adjusted to 5.5 with a 30% sulfuric acid aqueous solution and the reaction solution was kept at 70° C. under agitation for 3 hours. After the reaction was concluded, the pH of the solution was adjusted to 8 with a 28% aqueous ammonia solution and diluted with water to form a water-soluble resin solution containing 50% solids. It is designated Resin Solution (a-3).

EXAMPLE 4

292 g of triethylenetetramine and 60 g of urea were put in the same reaction container as used in Example 1; subjected to deammoniation reaction at 150° C. for 1.5 hours. Then 240 g of urea and 52 g of N-aminopropylcyclohexylamine were added to the solution and the deammoniation reaction was carried out again at 120° C. for 4 hours. The reaction solution was diluted with water into a 60% aqueous solution. 93 g of epichlorohydrin was added dropwise thereto with a care that the solution did not overheat and the reaction solution was kept at 70° C. for 2 hours after the addition of the epichlorohydrin was completed. After the reaction was concluded, the solution was diluted with water to form a water-soluble resin solution containing 50% solids. It is designated Resin Solution (a-4).

EXAMPLE 5

206 g of diethylenetriamine, 61 g of monoethanolamine and 49 g of cyclohexeneoxide were put in the same reaction container as used in Example 1, reacted at 120° C. for 2 hours. Then 360 g of urea was added to the solution and it was subjected to deammoniation reaction at 120° C. for 3 hours. The solution was diluted with water into a 60% aqueous solution. 162 g of a 37% formalin aqueous solution was added thereto and the pH thereof was adjusted to 5 with a 98% sulfuric acid aqueous solution and the reaction solution was kept at 70° C. for 2 hours. The solution was diluted with water to form a water-soluble resin solution containing 50% solids. It is designated Resin Solution (a-5).

EXAMPLE 6

292 g of triethylenetetramine, 98 g of octahydro-4,7-metanoindene-1(2),5(6)-dimethaneamine, 49 g of cyclohexeneoxide and 120 g of urea were put in the same reaction container as used in Example 1, subjected to deammoniation reaction at 150° C. for 2 hours. After addition of 240 g of urea, the deammoinia reaction was carried out again at 120° C. for 4 hours. The reaction solution was diluted with water into a 60% aqueous solution. 122 g of a 37% formalin aqueous solution was added thereto and the pH thereof was adjusted to 5 with a 98% sulfuric acid aqueous solution and the reaction solution was kept at 70° C. for 2 hours. After the reaction was concluded, water was added and the pH of the solution was adjusted to 7 with a 28% aqueous ammonia solution and diluted with water to form a water-soluble resin solution containing 50% solids. It is designated water soluble Resin (a-6).

EXAMPLE 7

292 g of triethylenetetramine, 98 g of cyclohexeneoxide were put in the same reaction container as used in Example 1, maintained at 120° C. for 1.5 hours under a careful temperature control. 60 g of urea was added thereto and the mixture was subjected to deammoniation reaction at 150° C. for 1.5 hours. After addition of 240 g of urea, the deammoinia reaction was carried out again at 120° C. for 1.5 hours. The reaction solution was diluted with water into a 60% aqueous solution. 81 g of a 37% formalin aqueous solution was added thereto and the pH thereof was adjusted to 5 with a 98% sulfuric acid aqueous solution and the solution was reacted at 70° C. for 2 hours. 46 g of epichlorohydrin were added dropwise to the reaction mixture and the reaction solution was kept at 40° C. for 1 hour. After the reaction was concluded, water was added to form a water-soluble resin solution containing 50% solids. It is designated water soluble Resin (a-7).

EXAMPLE 8

206 g of diethylenetriamine and 240 g of urea were put in the same reaction container as used in Example 1, subjected to deammoniation reaction at 150° C. for 2 hours. Subsequently 49 g of cyclohexeneoxide and 90 g of urea were added thereto and the reaction was carried out at 120° C. for 3 hours. The reaction solution was diluted with water into a 60% aqueous solution. 81 g of a 37% formalin aqueous solution was added thereto and the pH thereof was adjusted to 5 with a 98% sulfuric acid aqueous solution and the reaction was carried out at 70° C. for 2 hours. After the reaction was concluded, the solution was diluted with water to form a water-soluble resin solution containing 50% solids. It is designated water soluble Resin (a-8).

EXAMPLE 9

292 g of triethylenetetramine, 120 g of urea and 98 g of octahydro-4,7-metanoindene-1(2),5(6)-dimethaneamine were put in the same reaction container as used in Example 1, subjected to deammoniation reaction at 160° C. for 2 hours. Subsequently 49 g of cyclohexeneoxide was added thereto and the reaction was carried out at 120° C. for 1.5 hours. After addition of 180 g of urea, the deammoinia reaction was carried out again at 120° C. for 2 hours. The reaction solution was diluted with water into a 60% aqueous solution. 81 g of a 37% formalin aqueous solution was added thereto and the pH thereof was adjusted to 5 with a 98% sulfuric acid aqueous solution and the reaction was carried out at 70° C. for 3 hours. After the reaction was concluded, the solution was diluted with water to form a water-soluble resin solution containing 50% solids. It is designated water soluble Resin (a-9).

EXAMPLE 10

206 g of diethylenetriamine, 61 g of monoethanolamine and 49 g of cyclohexylamine were put in the same reaction container as used in Example 1, reacted at 120° C. for 2 hours. Then 360 g of urea was added to the solution and it was subjected to deammoniation reaction at 120° C. for 3 hours. The solution was diluted with water into a 60% aqueous solution. 162 g of a 37% formalin aqueous solution was added thereto and the pH thereof was adjusted to 5 with a 98% sulfuric acid aqueous solution and the reaction solution was kept at 70° C. for 2 hours. After the reaction was concluded, the solution was diluted with water to form a water-soluble resin solution containing 50% solids. It is designated Resin Solution (a-10).

EXAMPLE 11

292 g of triethylenetetramine, 85 g of isophoronediamine, 49 g of cyclohexeneoxide and 120 g of urea were put in the same reaction container as used in Example 1, subjected to deammoniation reaction at 150° C. for 2 hours. After addition of 240 g of urea, the deammoinia reaction was carried out again at 120° C. for 4 hours. The reaction solution was diluted with water into a 60% aqueous solution. 122 g of a 37% formalin aqueous solution was added thereto and the pH thereof was adjusted to 5 with a 98% sulfuric acid aqueous solution and the reaction solution was kept at 70° C. for 2 hours. After the reaction was concluded, water was added and the pH of the solution was adjusted to 7 with a 28% aqueous ammonia solution and diluted with water to form a water-soluble resin solution containing 50% solids. It is designated water soluble Resin (a-11).

COMPARATIVE EXAMPLE 1

292 g of triethylenetetramine and 60 g of urea were put in the same reaction container as used in Example 1, subjected to deammoniation reaction at 150° C. for 2 hours. After addition of 360 g of urea, the deammoinia reaction was carried out again at 120° C. for 3 hours.

The reaction solution was diluted with water into a 60% aqueous solution. 122 g of a 37% formalin aqueous solution was added thereto and the pH thereof was adjusted to 6 with a 98% sulfuric acid aqueous solution and the reaction solution was kept at 80° C. for 3 hours. After the reaction was concluded, the pH of the solution was adjusted to 8 with a 30% sodium hydroxide solution and then the solution was diluted with water to form a water-soluble resin solution containing 50% solids. It is designated water soluble Resin (c-1).

COMPARATIVE EXAMPLE 2

206 g of diethylenetriamine and 240 g of urea were put in the same reaction container as used in Example 1, subjected to deammoniation reaction at 160° C. for 2 hours. After the reaction was concluded, the reaction solution was diluted with water into a 60% aqueous solution. 81 g of a 37% formalin aqueous solution was added thereto and the pH thereof was adjusted to 5 with a 98% sulfuric acid aqueous solution and the reaction solution was kept at 70° C. for 2 hours. The solution was diluted with water to form a water-soluble resin solution containing 50% solids. It is designated water soluble Resin (c-2).

COMPARATIVE EXAMPLE 3

75 g of the water-soluble Resin (c-1) obtained by Comparative Example 1 and 25 g of glyoxal were mixed to give a water soluble resin. It is designated Resin Solution (c-3).

COMPARATIVE EXAMPLE 4

50 g of water-soluble Resin (c-2) obtained by Comparative Example 2 and 50 g of glyoxal were mixed to give a water soluble resin. It is designated Resin Solution (c-4).

EXAMPLE 12 AND COMPARATIVE EXAMPLE 5

Paper coating compositions were prepared using Resins (a-1)-(a-9) obtained by Examples 1-9 and Resins (c-1) to (c-4) by Comparative Examples 1-4 respectively in accordance with the following formulation. Each composition was diluted with water so as to adjust the solids content to 60% and the pH thereof was adjusted to 10 with a 30% sodium hydroxide solution to form the paper coating compositions to be tested. A control paper coating composition (Comparative Example 5) containing no paper coating resin was also prepared.

| | |
|---|---|
| Ultrawhite 90 (Clay produced by Engerhardt Minerals, Inc., U.S.A.) | 60 parts |
| Carbital 90 (Calcium carbonate produced by ECC Japan Kabushiki Kaisha) | 40 parts |
| JSR-0697 (Latex produced by Nihon Gosei Gomu Kabushiki Kaisha) | 12 parts |
| MS-4600 (Starch produced by Nihon Shokuhin Kako Kabushiki Kaisha) | 4 parts |
| Aron T-40 (Dispersant produced by Toa Gosei Kagaku Kogyo Kabushiki Kaisha) | 0.2 part |
| CarbomulΔS-10 (Lubricant produced by Dic-Hecules Chemicals Inc.) | 0.6 part |

-continued

| | |
|---|---|
| Resin* | 0.5 part |

NOTE: Here the term "part" represents weight part of solid.
Resin* Resins (a-1) to (a-9) and Resins (c-1) to (c-4) respectively These compositions were respectively applied to a surface of paper (basis weight: 95 g/m$^2$) with a laboratory blade coater (manufactured by Nippon Seiki Kabushiki Kaisha) so that the coating weight might be 10 g/m$^2$. Immediately after that, the coated paper was dried by a hot air at 110° C. for 5 sec. and then by a cylinder dryer at 90° C. for 5 sec. (The test coated papers for the blister test were similarly prepared except that the coating and drying were carried out on the both surfaces.) They were treated with a calender (roll temperature: 60° C.; linear pressure: 75 kg/cm) twice. (The papers for blister test were calendered on the both surfaces.) The thus obtained one-surface coated papers were subjected to a conditioning at 20° C., 65 RH (relative humidity) for 24 hours, and then tested with regard to the ink receptivity and the RI-printability represented by wet pick and dry pick. The viscosity of the paper coating composition when coated was also tested.

The test results are summarized in Table 1.

The tests were carried out as follows.

(i) Viscosity of the coating color

Viscosity of the coating color immediately after the preparation was measured using a B-type viscometer (Type BM manufactured by Tokyo Keiki Seisakusho) at 60 rpm, 25° C.

(ii) Ink receptivity

The coated surface was humidified with a humidifying roller and a test printing was carried out using a RI test printer (manufactured by Akira Seisakusho). Receptivity to ink was observed with the naked eye and estimated from Grade 1(poor) to Grade 5 (excellent).

(iii)Wet pick

The coated surface was humidified with a humidifying roller and a test printing was carried out using the RI test printer. Peeling of the coated paper was observed with the naked eye and estimated from Grade 1(poor) to Grade 5 (excellent).

(iv) Blister resistance

Webb offset ink was applied allover on the both surfaces of a both-surface coated paper using the RI test printer. The test paper was dipped in silicone oil in the constant temperature bath of the predetermined temperature for 3 sec. Blisters occurred on the coated paper were observed with the naked eye and estimated from Grade 1(poor) to Grade 5 (excellent).

(v) Wet rub

About 0.1 ml of deionized water was dropped on the coated surface and the spot was scrubbed with a fingertip 3, 5, 10, 15 and 20 times. Dissolved spots were transferred onto the surface of a black paper and the amounts of dissolution were respectively observed with the naked eye and estimated from Grade 1(poor) to Grade 5 (excellent).

TABLE 1

| Resin | Visc.* | Ink-Rec.** | Wet pick | Blister resist. | Wet rub | Coating*** weight |
|---|---|---|---|---|---|---|
| (a-1) | 780 | 5.0 | 5.0 | 5.0 | 4.5 | 10.5 |
| (a-2) | 800 | 5.0 | 4.5 | 5.0 | 4.5 | 10.2 |
| (a-3) | 700 | 4.5 | 4.0 | 4.5 | 4.0 | 10.0 |
| (a-4) | 750 | 4.5 | 4.5 | 4.5 | 5.0 | 10.3 |
| (a-5) | 770 | 4.0 | 5.0 | 4.0 | 5.0 | 10.8 |
| (a-6) | 770 | 4.0 | 5.0 | 4.5 | 5.0 | 10.4 |
| (a-7) | 870 | 5.0 | 4.0 | 5.0 | 4.5 | 10.2 |

TABLE 1-continued

| Resin | Visc.* | Ink-Rec.** | Wet pick | Blister resist. | Wet rub | Coating*** weight |
|---|---|---|---|---|---|---|
| (a-8) | 810 | 5.0 | 5.0 | 4.5 | 4.5 | 10.5 |
| (a-9) | 790 | 4.5 | 5.0 | 4.5 | 5.0 | 10.1 |
| (c-1) | 750 | 3.0 | 2.0 | 3.0 | 2.0 | 10.2 |
| (c-2) | 740 | 2.5 | 2.0 | 3.0 | 2.5 | 10.8 |
| (c-3) | 730 | 2.5 | 2.5 | 2.0 | 2.0 | 10.6 |
| (c-4) | 920 | 2.0 | 2.5 | 2.0 | 2.5 | 10.1 |
| No resin | 760 | 1.0 | 1.0 | 1.0 | 1.0 | 10.2 |

NOTES:
*Viscosity of the coating color (cps)
**Ink-receptivity
***$g/m^2$

As is apparent from the results, coated papers of the working examples prove to be excellent in the ink receptivity, wet pick, blister resistance and wet rub properties. In contrast, paper coating compositions of the comparative examples which do not contain either alicyclic amino compounds nor alicyclic epoxy compounds are apparently inferior in the effect of providing the ink receptivity, wet pick, blister resistance and wet rub properties.

REFERENTIAL EXAMPLE 1

292 g of triethylenetetramine and 60 g of urea were put in the same reaction container as used in Example 1, subjected to deammoniation reaction at 150° C. for 2 hours. After addition of 360 g of urea, the deammoinia reaction was carried out again at 120°0 C. for 3 hours. The reaction solution was diluted with water into a 60% aqueous solution. 122 g of a 37% formalin aqueous solution was added thereto and the pH thereof was adjusted to 6 with a 98% sulfuric acid aqueous solution and the reaction solution was kept at 80° C. for 3 hours. After the reaction was concluded, the pH of the solution was adjusted to 8 with a 30% sodium hydroxide aqueous solution and diluted with water to form a water-soluble resin solution containing 50% solids. It is designated water soluble Resin (a-12).

REFERENTIAL EXAMPLE 2

206 g of diethylenetriamine and 240 g of urea were put in the same reaction container as used in Example 1, subjected to deammoniation reaction at 160° C. for 2 hours. After the reaction was concluded, the reaction solution was diluted with water into a 60% aqueous solution. 81 g of a 37% formalin aqueous solution was added thereto and the pH of the solution was adjusted to 5 with a 98% sulfuric acid aqueous solution. The reaction solution was kept at 70° C. for 2 hours and diluted with water to form a water-soluble resin solution containing 50% solids. It is designated water soluble Resin (a-13).

REFERENTIAL EXAMPLE 3

103 g of diethylenetriamine and 10 g of octahydro-4,7-metanoindene-1(2),5(6)-dimethaneamine were put in the same reaction container as used in Example 1, diluted with 170 g of water. 10 g of a 98% sulfuric acid aqueous solution was added thereto and 93 g of epichlorohydrin was dropped into the solution at 30°–40° C. for 2 hours under agitation. After the addition was completed, the reaction solution was maintained at 60° C. for 2 hours and diluted with water to form a water-soluble resin solution containing 40% solids. It is designated water soluble Resin (b-1).

REFERENTIAL EXAMPLE 4

103 g of diethylenetriamine and 10 g of octahydro-4,7-metanoindene-1(2),5(6)-dimethaneamine were put in the same reaction container as used in Example 1, diluted with 198 g of water. 19 g of anhydrous sodium bisulfite was added thereto under agitation and 18 g of epichlorohydrin was dropped into the solution at 30°–40° C. for 2 hours under agitation. After the addition was completed, the reaction solution was maintained at 60° C. for 2 hours and diluted with water to form a water-soluble resin solution containing 40% solids. It is designated water soluble Resin (b-2).

REFERENTIAL EXAMPLE 5

103 g of diethylenetriamine and 7 g of 1,3-bis-(aminomethyl)cyclohexane were put in the same reaction container as used in Example 1, diluted with 166 g of water. 93 g of epichlorohydrin was dropped into the solution at 30°–40° C. for 2 hours under agitation. After the addition was completed, the reaction solution was maintained at 60° C. for 2 hours and diluted with water to form a water-soluble resin solution containing 40% solids. It is designated water soluble Resin (b-3).

REFERENTIAL EXAMPLE 6

24 g of monoethanolamine and 20 g of octahydro-4,7-methanoindene-1(2),5(6)-dimethanea were put in the same reaction container as used in Example 1, diluted with 141 g of water. 50 g of sodium sulfite was added thereto under agitation and 93 g of epichlorohydrin was dropped into the solution at 30°–40° C. for 2 hours. After the addition was completed, the reaction solution was maintained at 60° C. for 2 hours and diluted with water to form a water-soluble resin solution containing 30% solids. It is designated water soluble Resin (b-4).

REFERENTIAL EXAMPLE 7

103 g of diethylenetriamine and 13 g of 3,4-epoxycyclohexylmethyl-3,4-epoxy-cyclohexane-carboxylate were put in the same reaction container as used in Example 1, diluted with 174 g of water. 93 g of epichlorohydrin was dropped into the solution at 30°–40° C. for 2 hours under agitation. After the addition was completed, the reaction solution was maintained at 60° C. for 1.5 hours and diluted with water to form a water-soluble resin solution containing 40% solids. It is designated water soluble Resin (b-5).

REFERENTIAL EXAMPLE 8

103 g of diethylenetriamine was put in the same reaction container as used in Example 1, diluted with 221 g of water. 93 g of epichlorohydrin was dropped into the solution at 30°–40° C. for 3 hours under agitation. After the addition was completed, the reaction solution was maintained at 60° C. for 2 hours and diluted with water to form a water-soluble resin solution containing 40% solids. It is designated water soluble Resin (b-6).

REFERENTIAL EXAMPLE 9

90 g of dimethylamine (50%) was put in the same reaction container as used in Example 1, diluted with 22 g of water. 93 g of epichlorohydrin was dropped into the solution at 30°–40°0 C. for 2 hours under agitation. After the addition was completed, the reaction solution was maintained at 60° C. for 2 hours and diluted with water to form a water-soluble resin solution containing 40% solids. It is designated water soluble Resin (b-7).

EXAMPLE 13

A paper coating resin of 49% solids was obtained by mixing 90 g of Resin (a-1) and 10 g of Resin (b-1) and maintaining the mixture at 60° C. for 5 hours. It is designated Resin A.

EXAMPLE 14

A paper coating resin of 48% solids was obtained by mixing 80 g of Resin (a-2) and 20 g of Resin (b-2) and maintaining the mixture at 80° C. for 5 hours. It is designated Resin B.

EXAMPLE 15

A paper coating resin of 47% solids was obtained by mixing 70 g of Resin (a-3) and 30 g of Resin (b-3) and maintaining the mixture at 80° C. for 2 hours. It is designated Resin C.

EXAMPLE 16

A paper coating resin of 49.5% solids was obtained by mixing 95 g of Resin (a-11) and 5 g of Resin (b-7) and maintaining the mixture at 50° C. for 8 hours. It is designated Resin D.

EXAMPLE 17

A paper coating resin of 47% solids was obtained by mixing 70 g of Resin (a-12) and 30 g of Resin (b-3) and maintaining the mixture at 70° C. for 4 hours. It is designated Resin E.

EXAMPLE 18

A paper coating resin of 49% solids was obtained by mixing 95 g of Resin (a-4) and 5 g of Resin (b-4). It is designated Resin F.

EXAMPLE 19

A paper coating resin of 48% solids was obtained by mixing 80 g of Resin (a-7) and 20 g of Resin (b-6). It is designated Resin G.

EXAMPLE 20

A paper coating resin of 44% solids was obtained by mixing 70 g of Resin (a-8) and 30 g of Resin (b-5). It is designated Resin H.

EXAMPLE 21

A paper coating resin of 49% solids was obtained by mixing 95 g of Resin (a-9) and 5 g of Resin (b-4). It is designated Resin I.

EXAMPLE 22

A paper coating resin of 49% solids was obtained by mixing 90 g of Resin (a-10) and 10 g of Resin (b-5). It is designated Resin J.

EXAMPLE 23

A paper coating resin of 47% solids was obtained by mixing 70 g of Resin (a-13) and 30 g of Resin (b-2). It is designated Resin K.

COMPARATIVE EXAMPLE 6

A paper coating resin of 49% solids was obtained by mixing 90 g of Resin (a-12) and 10 g of Resin (b-6) and maintaining the mixture at 60° C. for 4 hours. It is designated Resin p.

COMPARATIVE EXAMPLE 7

A paper coating resin of 48% solids was obtained by mixing 80 g of Resin (a-13) and 20 g of Resin (b-7). Hereinafter it is designated Resin q.

COMPARATIVE EXAMPLE 8

A paper coating resin of 48% solids was obtained by mixing 80 g of Resin (a-13) and 20 g of glyoxal. It is designated Resin r.

EXAMPLE 24 AND COMPARATIVE EXAMPLE 9

Paper coating compositions were prepared using Resins A-K obtained by Examples 13–23, Resins p to r by Comparative Examples 6–8 and Resin (a-12) by Referential Example 1 respectively in accordance with the following formulation. Each composition was diluted with water so as to adjust the solids content to 50% and the pH thereof was adjusted to 11 with a 30% sodium hydroxide solution to form the paper coating compositions to be tested. A control paper coating composition (Comparative Example 9) containing no paper coating resin was also prepared. A paper coating composition containing paper coating resin (b-6) was also tried to be prepared but the viscosity increase was too high to use.

| | |
|---|---|
| Ultrawhite 90 (Clay produced by Engerhardt Minerals, Inc., U.S.A.) | 60 parts |
| Carbital 90 (Calcium carbonate produced by ECC Japan Kabushiki Kaisha) | 40 parts |
| JSR-0697 (Latex produced by Nihon Gosei Gomu Kabushiki Kaisha) | 12 parts |
| MS-4600 (Starch produced by Nihon Shokuhin Kako Kabushiki Kaisha) | 4 parts |
| Aron T-40 (Dispersant produced by Toa Gosei Kagaku Kogyo Kabushiki Kaisha) | 0.2 part |
| CarbomulΔS-10 (Lubricant produced by Dic-Hecules Chemicals Inc.) | 0.6 part |
| Resin* | 0.5 part |

NOTE: Here the term "part" represents weight part of solid.
Resin* Resins A-K, p-r and (a-12) respectively Each of the composition was tested in the same way as in Example 12. The results are summarized in Table 2.

As is apparent from the results, coated papers of the working examples prove to be excellent in the ink receptivity, wet pick, blister resistance and wet rub properties. In contrast, paper coated compositions of the comparative examples which do not contain either alicyclic amino compounds nor alicyclic epoxy compounds are apparently inferior in the effect of providing the ink receptivity, wet pick, blister resistance and wet rub properties.

TABLE 2

| Resin | Visc.* | Ink-Rec.** | Wet pick | Blister resist. | Wet rub | Coating*** weight |
|---|---|---|---|---|---|---|
| A | 155 | 4.9 | 4.8 | 5.0 | 5.0 | 10.2 |
| B | 208 | 4.9 | 5.0 | 5.0 | 5.0 | 10.1 |
| C | 137 | 4.5 | 4.8 | 4.8 | 4.5 | 10.6 |
| D | 199 | 5.0 | 5.0 | 4.5 | 4.3 | 10.2 |
| E | 152 | 4.6 | 4.8 | 5.0 | 4.3 | 10.8 |
| F | 141 | 4.3 | 5.0 | 4.0 | 4.0 | 10.4 |
| G | 162 | 4.8 | 5.0 | 5.0 | 4.4 | 10.2 |
| H | 140 | 4.2 | 4.7 | 4.6 | 4.4 | 10.5 |

TABLE 2-continued

| Resin | Visc.* | Ink-Rec.** | Wet pick | Blister resist. | Wet rub | Coating*** weight |
|---|---|---|---|---|---|---|
| I | 159 | 4.8 | 5.0 | 4.8 | 4.3 | 10.1 |
| J | 143 | 4.3 | 4.6 | 5.0 | 4.4 | 10.7 |
| K | 215 | 4.3 | 4.8 | 4.9 | 4.0 | 10.8 |
| p | 139 | 3.9 | 4.0 | 4.0 | 4.0 | 10.6 |
| q | 142 | 4.0 | 3.5 | 4.0 | 3.9 | 10.5 |
| r | 131 | 3.8 | 3.8 | 3.3 | 4.0 | 10.2 |
| No resin | 146 | 3.3 | 3.0 | 2.5 | 3.3 | 10.4 |
| (a-12) | 137 | 3.5 | 4.2 | 3.2 | 3.8 | 10.1 |

NOTES:
*Viscosity of the coating color (cps)
**Ink-receptivity
***$g/m^2$

It will be appreciated from the above description that the ink receptivity, wet pick, blister resistance and wet rub properties of coated papers can be improved in a good balance by using water-soluble resins of the present invention as a printability aid, said resins being obtainable by introducing alicyclic amino and/or alicyclic epoxy compounds into a polyalkylenepolyamine-urea-aldehyde(epihalohydrin) resin or by introducing alicyclic amino and/or alicyclic epoxy compounds into a polyalkylenepolyamine-urea-aldehyde(epihalohydrin) resin and/or an amine-epihalohydrin resin and reacting or mixing these resins. The effect is significant from the industrial viewpoint.

What we claim is:

1. A paper coating resin comprising a reaction product of a polyalkylenepolyamine, at least one compound selected from the group consisting of an alicyclic amino compound, an alicyclic epoxy compound and mixtures thereof; a urea and one or two or more compounds selected from the group consisting of formaldehyde, epihalohydrins and dialdehydes.

2. A paper coating composition comprising 0.05–5 weight parts of the paper coating resin of claim 1, 5–50 weight parts of binders (as solids content) and 100 weight parts of pigments.

* * * * *